United States Patent [19]

Tackett, Jr.

[11] 4,370,238

[45] Jan. 25, 1983

[54] PROCESS FOR DRYING SURFACTANT-CONTAINING CRUDE OIL

[75] Inventor: James E. Tackett, Jr., Littleton, Colo.

[73] Assignee: Marathon Oil Company, Findlay, Ohio

[21] Appl. No.: 38,964

[22] Filed: May 14, 1979

[51] Int. Cl.[3] ..... C10G 33/04

[52] U.S. Cl. ..... 210/639; 208/188

[58] Field of Search ..... 166/274, 273; 208/179, 208/181, 180, 290, 291, 187, 188; 210/21, 22, 23 R, 511, 634, 639

[56] References Cited

U.S. PATENT DOCUMENTS

| | | | |
|---|---|---|---|
| 1,842,983 | 1/1932 | Hanke | 208/181 |
| 1,882,002 | 10/1932 | Dietrich | 208/180 |
| 2,295,065 | 9/1942 | Vesterdal | 208/290 X |
| 2,377,565 | 6/1945 | McDonald | 210/23 R X |
| 2,846,359 | 8/1958 | Myers | 208/291 X |
| 3,417,012 | 12/1968 | Morace | 208/181 |
| 3,637,017 | 1/1972 | Gale et al. | 166/274 |
| 4,021,333 | 5/1977 | Habiby et al. | 208/179 |
| 4,216,079 | 8/1980 | Newcombe | 208/188 |

OTHER PUBLICATIONS

"Analysis of Oil Soluble Sodium Petroleum Sulfonates", ASTM Procedure D855, from ASTM Standards for Petroleum Products, Part 18, 1/68.

*Primary Examiner*—Frank A. Spear, Jr.
*Attorney, Agent, or Firm*—Jack L. Hummel

[57] ABSTRACT

The water content of a crude oil containing surfactant is reduced to less than 0.5 weight percent by first conventionally drying the crude oil to a water concentration less than about 10%, then contacting the crude oil with a low molecular weight alcohol to effect a phase separation into an aqueous layer and an oil layer, thereafter separating these layers to obtain a dried oil and an aqueous alcoholic surfactant solution. The alcohol can then be separated from the aqueous alcoholic surfactant solution. The recovered alcohol can be recycled through the system and the recovered surfactant can be reused in another micellar flood.

28 Claims, No Drawings

PROCESS FOR DRYING SURFACTANT-CONTAINING CRUDE OIL

DESCRIPTION

TECHNICAL FIELD

This invention relates to the drying, by removal of surfactant, of surfactant displaced crude oil to render the crude oil conducive to conventional transportation and refining techniques.

BACKGROUND ART

Prior Art Statement

There are many well known techniques for breaking emulsions, for example, gravitational settling, centrifugation, heating, the application of electrical fields and the addition of salt or deemulsifiers to the emulsion. U.S. Pat. No. 3,245,466 teaches breaking oil-in-water emulsions obtained from the water flooding of an oil reservoir with a light hydrocarbon solvent for the crude oil in order to dissolve the crude oil from the emulsion, thereafter separating the mixture with gravity techniques. U.S. Pat. No. 3,491,835 utilizes gravity means to break heavy crude oil emulsions. However, these conventional means, in and of themselves, will not render a crude oil containing surfactant suitable for conventional refinery processes.

The use of alcohols in surfactant systems is also known. Alcohols have been used as cosolvents or cosurfactants to stabilize micellar dispersions containing water and oil. See, for example, U.S. Pat. Nos. 3,307,628, 3,520,365 and 3,682,247. Gale in U.S. Pat. No. 3,637,017 uses a dilute alcohol water drive solution as a stripping agent to increase the quantities of surfactant recovered from a formation, thereby increasing the quantity of oil recovered. Thereafter, the surfactant can be reused in the recovery operation. He also teaches the addition of alcohol to the surfactant flood which precedes the alcohol drive solution. Additionally, low molecular weight alcohols have been used in sulfonate manufacturing processes to extract oil raffinate from gas oil sulfonates. The alcohol is not removed from sulfonate and acts as a cosurfactant in the micellar dispersion which is formulated with the sulfonate. The prior art teaches the use of alcohol as an aid to a surfactant's solubilization of oil to form a more stable micellar dispersion of hydrocarbon, water and surfactant. It does not recognize the ability of small amounts of a low molecular weight alcohol to break the micellar formation allowing for the separation of water and surfactant from crude oil.

The use of surfactants in processes for the recovery of oil from subterranean formations may result in the produced oil containing 0.1% or more surfactant by weight. This surfactant can cause the oil to contain excessive water which is difficult to remove by conventional means and which makes it difficult to transport the produced oil. Such surfactants can also cause the formation of emulsions during conventional refinery desalting processes resulting from the addition of water to the produced oil. Thus, the process of the present invention provides not only for the removal of water, but also for the removal of surfactants from these micellar produced crude oils in order to prevent the formation of subsequent emulsions.

DISCLOSURE OF INVENTION

The water content of a produced crude oil containing a sufficient amount of surfactant to prevent adequate drying of the oil and cause interference with the processing and refining of the crude, is reduced to 10% or less by conventional means. Thereafter, the produced crude oil containing surfactant is contacted with a low molecular weight alcohol to effect a separation of the crude oil into an oil top layer and an aqueous bottom layer containing surfactant. These layers are then separated, and the resulting crude oil which contains less than 0.5% water can be transported and refined by conventional processes. The surfactant and alcohol of the aqueous layer can then be separated by conventional techniques, such as distillation. The alcohol can be recycled through the system and the surfactant can be reused in another micellar flood.

BEST MODE FOR CARRYING OUT THE INVENTION

The process of this invention is applicable to any crude oil which contains surfactant in an amount equal to or greater than 0.1% by weight. Crude oil often contains surfactant as a result of being produced by secondary and/or tertiary oil recovery processes which utilize fluid floods containing surfactants. Examples of such floods containing surfactants include, for example, foam floods, aqueous solutions, caustic floods, emulsions and micellar dispersions. The process of the invention is especially beneficial for the crude oils produced by micellar dispersions. The term micellar dispersions, is intended to encompass, for example, micellar flooding with systems of the type taught by H. J. Hill, J. Reisberg, and G. L. Stegemeier, J. Pet. Tech., 186 (Feb., 1973), wherein relatively dilute aqueous "solutions" of surfactant and/or cosurfactant are injected: the process of R. L. Reed et al., U.S. Pat. No. 3,885,628, wherein a multiphase system is injected; and U.S. Pat. No. 3,082,822 issued to L. W. Holm et al., wherein substantially small slugs of anhydrous soluble oils are alternately injected with small slugs of water or other aqueous media.

The surfactant is any of the conventional surfactants used in processes for the recovery of oil. The surfactant can be nonionic, e.g., ethoxylated aliphatic alcohols, ethoxylated alkyl phenols and coconut diethanolamide; cationic, e.g., quaternary ammonium compounds, anionic, e.g. alkylaryl sulfonates, fatty alcohol sulfates, sulfated and sulfonated amides and amines, alkyl sulfonates, and sulfated and sulfonated esters and ethers; ampholytic, e.g. cetylaminoacetic acid; or mixtures of surfactants. The invention is especially applicable to crude oil containing petroleum sulfonates as a portion of or as all of the surfactant. Examples of petroleum sulfonates include sulfonates from whole crude oil, topped crude oil, wherein a portion of the light ends of the crude oil having a boiling point less than 315° C. has been removed, semirefined and refined fractions of crude oil.

The amount of surfactant contained in the produced crude oil is dependent upon the surfactant formulation used, the reservoir, and the stage or maturity of the oil recovery process. Generally, the crude oils produced by surfactant floods may contain from traces to about 5% surfactant. The drying process is effective on higher concentrations of surfactant. Lower concentrations of surfactant do not render the crude oil unsuitable for conventional transportation or refining techniques.

Crude oil produced with the use of surfactant flood(s) generally contains from traces to greater than 10 percent water depending upon the maturity of the flood. Therefore, to obtain an effective extraction of the surfactant from the crude oil, the water content of the oil is reduced to about 10% or less, when necessary. This can be done through the use of conventional techniques, for example, the addition of inorganic salt or a conventional deemulsifier such as triethanolamine, ethoxylated phenol resin or oxygenated polyamine, gravitational settling, centrifugation, heating and the application of electrical fields. The water content of the crude oil can be reduced to 10% either in the field or at the processing plant or a portion removed in the field with the remainder being removed at the processing plant. It is preferred that the water content be reduced in the field and that the alcohol extraction process of this invention be done in the field.

Prior to contacting the crude oil with the low molecular weight alcohol, the water content of the crude oil should be from about 1.5 to about 10%. If the water content is reduced to less than 1.5% then an aqueous alcoholic solution should be used to extract the solvent to prevent possible flotation of the alcohol solution on the oil layer. This flotation is not detrimental to the separation process, but requires modifications of field equipment to accommodate the change in fluid positions.

The alcohols used in the extraction of surfactant from the produced crude oil include alcohols containing from one to three carbon atoms per hydroxy group, the ethoxylated products of these alcohols, e.g. 2-(2-ethoxyethoxy) ethanol, 2, 2'-oxydiethanol and ethylene glycol, and mixtures thereof. Alcohols containing more than three carbon atoms per hydroxy group are not as effective in removing sulfonates from the surfactant containing crude oil. Generally, the fewer carbon atoms the alcohol contains, the more efficient (in terms of amount of alcohol and time required for extraction) the extraction is. Thus, methanol is usually preferred over ethanol which is preferred over isopropanol. The alcohol or ethoxylated alcohol should be miscible with water so that it will cause the desolubilization of water from the surfactant containing crude oil. The alcohol is employed in a pure form (anhydrous) or as an aqueous solution. The amount of water in the aqueous solution is not critical as long as the total amount of water added plus the water in the crude does not exceed about 12% of the total volume. The alcohol is employed in the extraction process in an amount of from about 0.5 to about 15 percent, preferably from about 1 to about 10 percent and more preferably from about 2.5 to about 5 percent based on the volume of crude oil being processed. For a given type of surfactant, the amount of water removed is dependent upon the surfactant concentration; and with reference to the stated alcohol ranges, the phase separation is generally increased by using higher amounts of alcohol.

Concentrated salt solutions can be used in conjunction with the alcohol extraction. Such solutions facilitate surfactant removal from the oil and are particularly beneficial in reducing the amount of water that the dried oil will pick up when subjected to additional water mixing such as might occur in a refinery desalter. When concentrated salt solutions are used without alcohol addition, dry oils can be obtained, but additional water pick up will occur in the desalter process. The concentrated salt solutions are generally saturated salt solutions of salts conventionally used to dry oil in production or refinery operations. Useful salts are generally monovalent or divalent. Examples of such salts include sodium chloride, calcium chloride, sodium acetate, sodium nitrate and sodium chlorate. The salt solution is added with the alcohol in an amount equivalent to about 2 to about 10 percent (weight of dry salt) of crude oil volume depending on the type of salt and the crude oil being processed.

The extraction process can be either continuous or a batch-wise operation. Conventional regular or reverse deemulsifying agents, such as triethanolamine, ethoxylated phenol resins, zinc chloride and polymerized trithionylamine can be used in conjunction with the alcohol extraction. The extraction technique is not critical and any technique allowing for phase separation can be used.

After the surfactant-containing crude oil is contacted with the alcohol, it is allowed to undergo a phase separation into an aqueous layer, which contains the sulfonate surfactants and alcohol, and a layer of oil. These two layers are then separated and the oil phase is subjected to further refining processes. The aqueous phase can be recycled with no further processing back into another surfactant flood for use preferably in the same formation. Alternatively, the aqueous phase can be subjected to further processing in order to separate the alcohol from the surfactant. An example of one such process is distillation to remove oil, alcohol and some water from the surfactant. Thereafter, the surfactant can be reused in another surfactant flood used in a process for the recovery of oil. It is preferred that the surfactant flood containing this recycled surfactant be used in the same formation in which the surfactant has once been used. The alcohol which is separated from the aqueous phase can be recycled as an extractant solvent for the removal of surfactant from surfactant-containing crude oil.

The process of the present invention permits the economical use of fairly high concentrations of surfactant, from about 8 to about 15 weight percent based on 100% active surfactant, in surfactant floods of oil recovery processes. This relatively high concentration of surfactant minimizes the reservoir retention of surfactant. The additional costs associated with this amount of surfactant are reduced through the recovery and reuse of the surfactant in another flood.

EXAMPLE 1

A micellar produced crude oil was treated with conventional deemulsifiers and gravity settling to reduce its water content and obtain a crude oil containing 90.3% oil, 5.8% water and 3.9% petroleum sulfonates as the surfactant. This crude oil was then contacted with 2.5% methyl alcohol. The mixture was allowed to settle for 20 hours, then the aqueous methanol layer containing surfactant was separated from the now dry oil. The thus obtained dry oil contained 99.3% oil, 0.2% water, 0.2% methanol and 0.3% surfactant.

To simulate the effect of a refinery desalter operation, an equal amount of 1% aqueous sodium chloride solution was mixed with the dry oil. The mixture was allowed to settle for 2 hours. The top oil phase contained 0.4% water.

The aqueous methanol layer was subjected to a distillation process to obtain an aqueous surfactant solution and a methanol recycle solution. The surfactant solution contained 56.0% water, 43.0% surfactant and 1.0% oil, whereas, the methanol recycle solution contained 52.7% methanol, 30.6% water and 16.7% oil.

EXAMPLE 2

The same type of micellar produced crude oil used in Example 1, treated by conventional deemulsifiers and gravity settling to reduce its water content to 5.8%, was mixed with a 5% volume of the methanol recycle solution from Example 1 and allowed to settle for 2 hours. The dry oil which separated as a top layer contained 0.3% water.

EXAMPLE 3

The same type of crude oil used in Example 1 was treated with varying amounts of methanol. The percentage amount, based on the volume of crude oil treated, of methanol used is given in Table 1. Each of the samples was allowed to settle for 20 hours and then the aqueous methanol layer was separated from the dry oil phase. Analyses of the composition of the dry oils obtained are given in Table 1.

To simulate a refinery desalter operation, the dry oil was mixed with equal amounts of 1% sodium chloride and allowed to settle for 2 hours. To simulate a two-stage desalting operation, the dry oil from the 1% sodium chloride contact study was mixed with an equal amount of fresh water and allowed to settle for 2 hours. The results of both these desalting techniques are also presented in Table 1.

TABLE 1

| Methanol Added (%) | Water in Dry Oil (%) | Surfactant in Dry Oil (%) | Methanol in Dry Oil (%) | Desalter: Water in Dry Oil (%) | Two-stage Desalter: Water in Dry Oil (%) |
|---|---|---|---|---|---|
| 12.5 | 0.2 | 1.0 | 0.8 | 1.2 | 1.4 |
| 5.0 | 0.2 | 0.6 | 0.4 | 1.2 | 0.9 |
| 2.5 | 0.2 | 0.3 | 0.3 | 0.4 | 0.3 |
| 2.5 (50% aqueous solution) | 0.3 | 0.4 | 0.2 | 0.4 | — |
| 1.0 | 0.7 | 0.4 | — | 2.2 | — |

EXAMPLE 4

A micellar produced crude oil was treated by conventional deemulsifiers and gravity settling to reduce its water content to 6.5%, then the crude which contained 2.0% petroleum sulfonates was diluted with crude oil from conventional production without a surfactant to form a series of samples with different surfactant concentrations as shown in Table 2. Each of these samples was mixed with 2.5% methanol and some samples were mixed with 1.0% methanol, all of the samples were allowed to settle for 20 hours. The amount of water in the separated dry oil phase was then measured.

TABLE 2

| | Water in Dry Oil After 20 hours, % | |
|---|---|---|
| Surfactant % | 1.0% Methanol Added | 2.5% Methanol Added |
| 2.0 | — | 0.2 |
| 1.4 | — | 0.4 |
| 1.0 | 2.4 | 0.3 |
| 0.6 | 1.4 | 0.3 |
| 0.2 | 0.3 | 0.3 |

EXAMPLE 5

Samples of micellar produced crude oils from different stages of a surfactant flood were initially treated by settling to reduce their water content to less than 10%. Thereafter, each was treated with from 1 to 5% methanol based on the volume of the crude oil treated as indicated in Table 3. The mixture was allowed to settle and the phases separated. Analyses of the initial surfactant and water content of the crude oil treated, as well as the percentage of water contained in the dry oil after 2 and 20 hours, are given below in Table 3.

TABLE 3

| | | MeOH | Water in Dry Oil (%) | |
|---|---|---|---|---|
| Surfactant (%) | Water (%) | added (%) | 2 Hours | 20 Hours |
| 0.1 | — | 1.0 (10% aqueous solution) | 0.2 | 0.3 |
| 0.4 | 0.5 | 1.0 (10% aqueous solution) | 2.0 | 0.8 |
| 0.6 | 1.4 | 1.0 | 0.8 | 0.2 |
| 0.6 | 1.4 | 2.5 | 0.3 | 0.1 |
| 0.7 | 5.1 | 1.0 | 4.6 | 2.8 |
| 0.7 | 5.1 | 2.5 | 4.1 | 0.2 |
| 1.4 | 3.5 | 1.0 | 3.9 | 3.5 |
| 1.4 | 3.5 | 2.5 | 3.8 | 1.7 |
| 1.8 | 5.3 | 1.0 | 0.6 | 0.7 |
| 1.8 | 5.3 | 2.5 | 0.4 | 0.4 |
| 1.8 | 5.3 | 5.0 | 0.3 | 0.3 |

EXAMPLE 6

The same type of micellar produced crude oil used in Example 1, treated by conventional deemulsifiers and gravity settling to reduce its water content to 6.5%, was mixed with a variety of additives as indicated in Table 4 and allowed to settle for 20 hours. The resultant dry oil top phases were analyzed for water by Karl Fischer titration after 2 hours and after 20 hours of settling. The results are presented below in Table 4.

TABLE 4

| | Amount | Water in Dry Oil (%) | |
|---|---|---|---|
| Additive | Added (% by volume) | 2 Hours | 20 Hours |
| Methanol | 12.5 | 0.9 | 0.2 |
| Ethanol | 12.5 | 0.5 | 0.3 |
| 2-Propanol | 12.5 | 0.9 | 0.4 |
| n-butanol | 12.5 | 1.6 | 1.4 |
| 2,2'-Oxydiethanol | 12.5 | — | 0.1 |
| Ethylene Glycol | 12.5 | 2.5 | 0.1 |
| Carbitol | 5 | .3 | 0.2 |
| $CaCl_2$ (50% solution) | 28 | — | 0.2 |
| NaCl (30% solution) | 25 | — | 1.2 |

The dried oil obtained from the extraction with the 50% calcium chloride solution was contacted with an equivalent amount of 1% sodium chloride solution. After settling for 2 hours, it was found that the water content of the oil phase increased to 6.7%.

EXAMPLE 7

The same type of micellar produced crude oil used in Example 1, treated by conventional means to reduce its water content to 6.5%, was mixed with alcohol and inorganic salts as indicated in Table 5 and allowed to settle for 20 hours. The resultant dry oil top phases were analyzed for water. This oil was then mixed with an equal amount of 1% sodium chloride solution and allowed to settle for 2 hours to simulate a refinery desalter. The water content of the top oil phase was then determined. The results are presented below in Table 5.

TABLE 5

| Alcohol, % Volume | Salt, wt/vol of crude | Water in Dry Oil, % | Water in Dry Oil After Contact With 1% NaCl |
|---|---|---|---|
| Ethylene Glycol, 12.5 | none | 0.1 | 1.2 |
| Ethylene Glycol 12.5 | $NaClO_3$,4 | 0.1 | 0.4 |
| Methanol, 5 | none | 0.2 | 1.2 |
| Methanol, 5 | Na Acetate, 4 | 0.2 | 0.5 |
| Methanol, 5 | $NaNO_3$,4 | 0.2 | 0.4 |
| Methanol, 2.5 | none | 0.2 | 0.4 |
| Methanol, 2.5 | $NaNO_3$,4 | 0.1 | 0.3 |
| Methanol, 1 | none | 0.7 | 2.2 |
| Methanol, 1 | $NaNO_3$,4 | 0.7 | 1.0 |

What is claimed is:

1. A process for the removal of surfactant from a surfactant produced crude oil comprising drying the micellar produced crude oil to a water content of less than about 10%, and thereafter extracting the surfactant and remaining water from the surfactant produced crude oil with an alcohol selected from the group consisting of alcohols having a carbon to hydroxy group ratio of 3 or less, ethoxylated products of these alcohols and mixtures thereof wherein the alcohol contains less than about 12 percent by volume water.

2. A process for drying a crude oil containing surfactant to a water content of less than 0.5 weight percent, comprising the steps of:

reducing the water content of the crude oil containing surfactant to less than about 10%;

contacting the partially dried crude oil with an alcohol selected from the group consisting of alcohols having a carbon to hydroxy group ratio of 3 or less, ethoxylated products of these alcohols and mixtures thereof wherein the alcohol contains less than about 12 percent by volume water;

allowing the mixture to separate into a dried oil layer and an aqueous alcoholic layer containing surfactant;

separating the dried oil layer from the aqueous layer; and processing the aqueous alcoholic layer to separate the alcohol from the surfactant.

3. The process of claim 1 or claim 2 wherein prior to the drying process the crude oil contains at least 0.1 weight percent of surfactant.

4. The process of claim 1 or claim 2 wherein the alcohol is selected from the group consisting of methanol, ethanol, propanol, ethoxylated products of these alcohols and mixtures thereof.

5. The process of claim 4 wherein the alcohol is employed in an amount of from about 0.5 to about 15 percent by volume of the crude oil being processed.

6. The process of claim 5 wherein the alcohol is anhydrous.

7. The process of claim 5 wherein the alcohol is methanol.

8. The process of claim 3 wherein the surfactant produced crude oil is produced from a subterranean formation by a micellar dispersion comprised of water, hydrocarbon and surfactant.

9. The process of claim 8 wherein the surfactant recovered from the micellar produced crude oil is reused as a component of another surfactant flood of the subterranean formation and the alcohol recovered from the extraction process is recycled back to the extraction process.

10. In a process for the refining of surfactant produced crude oil to obtain petroleum products, the improvement comprising:

drying the surfactant produced crude oil to a water content of about 10% or less, and thereafter extracting the surfactant and remaining water from the crude oil with an alcohol selected from the group consisting of alcohols having a carbon to hydroxy group ratio of 3 or less, ethoxylated products of these alcohols and mixtures thereof prior to a desalting operation.

11. The process of claim 10 wherein the surfactant produced crude oil contains at least about 0.1 percent by weight surfactant prior to the drying process.

12. The process of claim 10 wherein alcohol is selected from the group consisting of methanol, ethanol, propanol, ethoxylated products of these alcohols and mixtures thereof.

13. The process of claim 12 wherein the alcohol is anhydrous.

14. The process of claim 12 wherein the alcohol is an aqueous solution, which after contact with the crude oil produces a mixture that contains less than about 12 percent by volume of water.

15. The process of claim 12 wherein the alcohol is employed in an amount of from about 0.5 to about 15 percent by volume of the crude oil being processed.

16. The process of claim 15 wherein the alcohol is methanol.

17. The process of claim 15 wherein the alcohol is ethanol.

18. The process of claim 15 wherein the alcohol is propanol.

19. The process of claim 15 wherein the alcohol is ethylene glycol.

20. The process of claim 16 wherein the methanol is employed in an amount of from about 2.5 to about 5% by volume of the crude oil being processed.

21. The process of claim 15 wherein a saturated salt solution is employed in conjunction with the alcohol.

22. The process of claim 21 wherein the salt solution is employed in an amount of from about 2 to about 10 percent weight of dry salt volume of the crude oil being processed.

23. The process of claim 12 wherein the surfactant produced crude oil is initially dried to a water content of less than about 10% by gravitational settling.

24. The process of claim 12 wherein the surfactant produced crude oil is initially dried to a water content of less than about 10% by centrifugation.

25. The process of claim 12 wherein the surfactant produced crude oil is initially dried to a water content of less than about 10% by the application of an electrical field.

26. The process of claim 12 wherein the surfactant produced crude oil is initially dried to a water content of less than about 10% by the addition of a deemulsifying agent.

27. The process of claim 26 wherein the deemulsifying agent is selected from the group consisting of triethanolamine, ethoxylated phenol resins, zinc chloride, polymerized trithionylamines, oxygenated polyamines, and mixtures thereof.

28. A process for the removal of surfactant from a surfactant produced crude oil comprising drying the micellar produced crude oil to a water content of less than about 10%, and thereafter extracting the surfactant and remaining water from the surfactant produced crude oil with an alcohol selected from the group consisting of alcohols having a carbon to hydroxy group ratio of 3 or less, ethoxylated products of these alcohols and mixtures thereof wherein the alcohol is employed in an amount of from about 0.5 to about 15 percent by volume of the crude oil being processed.

* * * * *